US009797106B1

(12) United States Patent
Smith et al.

(10) Patent No.: US 9,797,106 B1
(45) Date of Patent: Oct. 24, 2017

(54) METHOD OF INSTALLING REVETMENT BLOCKS TO REDUCE KINETIC ENERGY OF WATER

(71) Applicants: Lee A. Smith, Houston, TX (US); James S. Kole, Jr., Houston, TX (US)

(72) Inventors: Lee A. Smith, Houston, TX (US); James S. Kole, Jr., Houston, TX (US)

( * ) Notice: Subject to any disclaimer, the term of this patent is extended or adjusted under 35 U.S.C. 154(b) by 0 days.

(21) Appl. No.: 14/934,379

(22) Filed: Nov. 6, 2015

Related U.S. Application Data

(60) Provisional application No. 62/123,094, filed on Nov. 6, 2014.

(51) Int. Cl.
*E02B 3/14* (2006.01)

(52) U.S. Cl.
CPC ..... *E02B 3/14* (2013.01)

(58) Field of Classification Search
CPC ..... E02D 17/205
USPC ..... 405/15–17, 19, 20, 21, 25, 29, 302.4, 405/302.6
See application file for complete search history.

(56) References Cited

U.S. PATENT DOCUMENTS

| | | | | |
|---|---|---|---|---|
| 1,164,707 | A | 12/1915 | Edinger | |
| 1,164,708 | A | 12/1915 | Edinger | |
| 1,561,796 | A | 11/1925 | Rehbock | |
| 2,171,560 | A | 9/1939 | Holmes et al. | |
| 3,347,048 | A | 10/1967 | Brown et al. | |
| 3,854,291 | A | 12/1974 | Perkins | |
| 4,269,537 | A | 5/1981 | O'Neill | |
| 4,279,536 | A * | 7/1981 | Jarlan | E02B 3/14 405/21 |
| 4,352,593 | A | 10/1982 | Iskra et al. | |
| 4,465,398 | A | 8/1984 | Knudsen | |
| 4,781,492 | A | 11/1988 | Shindo | |
| 4,813,812 | A | 3/1989 | Hasegawa et al. | |
| 4,856,934 | A | 8/1989 | Nelson | |
| 4,875,803 | A | 10/1989 | Scales | |
| 4,978,247 | A | 12/1990 | Lenson | |
| 5,020,938 | A | 6/1991 | Scales | |
| 5,544,973 | A | 8/1996 | Frizell et al. | |
| 5,556,228 | A | 9/1996 | Smith | |
| 6,079,902 | A | 6/2000 | Pettee, Jr. | |
| 6,267,533 | B1 | 7/2001 | Bourg | |
| 6,276,870 | B1 | 8/2001 | Smith | |
| 6,508,607 | B1 | 1/2003 | Smith et al. | |
| 6,955,500 | B1 | 10/2005 | Smith et al. | |
| 7,037,037 | B1 | 5/2006 | Smith et al. | |
| 7,717,643 | B2 | 5/2010 | Han | |

(Continued)

FOREIGN PATENT DOCUMENTS

| | | | |
|---|---|---|---|
| JP | 04024310 | * | 1/1992 |

*Primary Examiner* — Sean Andrish
(74) *Attorney, Agent, or Firm* — Roger N. Chauza, PC

(57) ABSTRACT

A revetment block for reducing the energy of water flowing over a levee. The revetment blocks each have a tapered top surface that tapers upwardly from a downstream end of the block to an upstream end of the block. The upwardly tapered top surface terminates in an abrupt downward transition edge. When plural tapered top blocks are installed together in a mat on a surface of the levee, the oncoming water surge encounters the many abrupt transition edges and reduces the energy of the water surge. The tapered top revetment blocks can be installed on the water side of the levee, or on the land side of the levee, or both sides.

14 Claims, 5 Drawing Sheets

(56) References Cited

U.S. PATENT DOCUMENTS

| | | | |
|---|---|---|---|
| 8,123,434 | B1 | 2/2012 | Smith |
| 8,123,435 | B1 | 2/2012 | DeShaw et al. |
| 8,678,704 | B1 | 3/2014 | Smith et al. |
| 8,678,705 | B1 | 3/2014 | Smith et al. |

* cited by examiner

METHOD OF INSTALLING REVETMENT BLOCKS TO REDUCE KINETIC ENERGY OF WATER

RELATED APPLICATION

This U.S. non-provisional patent application claims the benefit of U.S. provisional application Ser. No. 62/123,094, filed Nov. 6, 2014.

TECHNICAL FIELD OF THE INVENTION

The present invention relates in general to revetment blocks, and more particularly to revetment blocks and methods of installing such blocks on a levee to reduce the energy of surge water flowing over the levee.

BACKGROUND OF THE INVENTION

Revetment blocks are available in many different shapes and sizes to accommodate different situations to control the erosion of soil. Revetment blocks can be constructed with arms and sockets that interengage together, but are not positively interlocking to prevent lateral separation of neighbor blocks interlocked together. Other revetment blocks have positive interlocking arms and sockets so that when installed in an interlocking manner, the blocks cannot be laterally removed from each other, thereby allowing heavy water flows thereover without dislodging any of the blocks. Such a revetment block is disclosed in U.S. Pat. No. 5,556,228 by Smith.

In order to prevent erosion of the soil in a waterway, revetment blocks are installed as a mat to cover the entire area to be protected from erosion. This often involves lining the bottom and sides of the waterway with revetment blocks so that the water flows over the revetment blocks and the underlying soil is protected from erosion. The particular type of revetment block can be selected based on the velocity and the volume of water that is expected to flow down the waterway. Engineers and hydraulic specialists can determine what style of revetment block is best adapted for these conditions.

Additional conditions taken into consideration is the direction of water flow in the channel or waterway. Since the direction of the flow of water is generally in the same direction, this is usually not a variable that must be considered. However, certain revetment blocks are constructed to control various aspects of the water flow, and thus such blocks must be installed in a certain orientation in order to assure that the water reacts in the proper way when flowing over the blocks. For example, U.S. Pat. No. 8,678,704 by Smith discloses a tapered top revetment block that is installed in a waterway in a certain orientation so that the tapered top tapers upwardly in a downstream direction to reduce the lifting force exerted on the mat of blocks and thus increases the factor of safety. U.S. Pat. No. 8,123,434 by Smith discloses a mat of interlocking revetment blocks where certain blocks of the mat have different heights to thereby form interruptions in the flow of water and create turbulence to slow down the velocity of the water. In other words, by using different height blocks in the mat, the roughness coefficient of the mat is increased, thus slowing down the velocity of the water flowing thereover. The roughness coefficient of a mat of revetment blocks is also known as "Mannings N."

A field of concern that has not been addressed in terms of water control is that of wave surges during times when higher than usual waves surge over areas that are usually not protected from erosion. For example, wave surges can be experienced during hurricanes, tidal waves, tsunamis, etc., where the surges of waves flow over dams, levees and the like. The hurricane Katrina hit the New Orleans area and breached many of the levees to the extent that the levees no longer protected the land side. Since the landside of the levees generally did not experience water flow, there was often no protection on such side of the levee, except that which was necessary to prevent erosion of the levee during heavy rainfalls. Often the river side of the levee was protected from erosion as that side of the levee experiences water flow in the downstream direction during flooding of the river.

When a levee experiences a storm surge, the waves can be sufficiently high as to flow over the levee and erode the backside of the levee, thereby reducing its strength and integrity. The wave surges are often caused by high winds. If the erosion on the backside of the levee continues, the levee can be breached so that water flow in either direction through the hole in the levee is possible, and flooding of the land side of the levee can occur. Moreover, as the wave surge flows over the levee, it speeds up as it flows down the incline on the land side of the levee, thereby accelerating soil erosion on the backside of the levee.

From the foregoing, it can be seen that a need exists for a technique to protect levees, and the like, from storm surges not only on the front side, but also on the backside or land side of the levee. A further need exists for a method of installing revetment blocks on the land side of a levee to slow down the velocity and energy of water and reduce the kinetic energy thereof as a wave surges over the levee. Another need exists for a method of protecting the land side of levees from erosion as well as controlling the energy of water flowing down the land side of the levee to reduce the destructive force of the water.

SUMMARY OF THE INVENTION

In accordance with an important feature of the invention, disclosed is revetment block that is constructed with a tapered top surface, where the taper terminated in a downward transition edge. When a number of the tapered top revetment blocks are installed as a mat over a surface of the levee, the flowing water encounters the many transition edges and reduces the energy of the water, thus minimizing the damaging effects of water as it surges over the levee.

The tapered top revetment blocks are particularly advantageous when installed on the land side of a levee so that water surges over the levee not only protect the ground on the land side, but also slow down the velocity of the water flowing down the land side of the levee. The roughened surface of the mat of revetment blocks occasioned by the many upwardly projecting transition edges, slows down the surge water and causes less damage to buildings and structures located on the land side of the levee.

The tapered top revetment blocks are preferably constructed with positive interlocking arms and sockets, although this type of engagement between neighbor blocks of a mat is not a necessity. The upstream and downstream arms or sockets of each revetment block can also be tapered in the same manner as the top surfaces of the blocks. The side edge arms and sockets of each block can also be tapered in the same manner as the top surface.

The tapered top revetment blocks can be installed in the same orientation on the water side of a levee, over the crest and on the land side of the levee to reduce the energy of water surging over the levee. Alternatively, the tapered top revetment blocks can be installed on the water side of the levee in a reverse orientation so as to be rotated 180 degrees, as compared to the tapered top revetment blocks installed on the land side of the levee. In this latter alternative, interface blocks on the crest of the levee can be utilized to mate the edge of the water side mat to the edge of the land side mat. In this alternative arrangement, the surge water that does not flow over the crest of the levee is reduced in energy as it flows back down the water side of the levee.

In accordance with an embodiment of the invention, disclosed is a method of controlling water flow over a levee having a water side and a land side. The method of this embodiment includes lining the land side of the levee with a mat of revetment blocks, where each revetment block has a frontal edge into which the water flowing down the levee on the water side abuts to thereby reduce the energy of the water. The revetment blocks are situated so that the respective frontal edges of the revetment blocks extend vertically above a downstream end of a similarly-constructed upstream neighbor revetment block.

According to another embodiment of the invention, disclosed is a method of controlling water flow over a levee having a crest located between a water side and a land side. The method of this embodiment includes installing a mat of revetment blocks on the land side of the levee from the crest of the levee to a downhill portion. The revetment blocks each have a tapered top surface tapering upwardly from a downstream end to an upstream end. The tapered top revetment blocks are installed so that a thicker end of each said revetment block is laid uphill and a thinner end of each said revetment block is laid downhill, so that a vertical transition edge is formed between neighbor revetment blocks. The transition edges of the revetment bocks are used to reduce the energy of the water flowing over the levee and down the land side thereof.

According to yet another embodiment of the invention, disclosed is a method of controlling water flow over a levee having a crest located between a water side and a land side. The method of this embodiment includes using revetment blocks having tapered top surfaces, where each of the tapered surfaces terminates in an abrupt downward transition edge. The tapered top revetment blocks are installed on the water side of the levee so that water returning downhill on the water side of the levee encounters the abrupt transition edges and slows the downhill flowing water down. The tapered top revetment blocks are also installed on the land side of the levee so that water flowing over the crest and downhill on the water side of the levee encounters the abrupt transition edges and slows down the water flowing downhill on the land side of the levee.

BRIEF DESCRIPTION OF THE DRAWINGS

Further features and advantages will become apparent from the following and more particular description of the preferred and other embodiments of the invention, as illustrated in the accompanying drawings in which like reference characters generally refer to the same parts, functions or elements throughout the views, and in which.

DETAILED DESCRIPTION OF THE INVENTION

Figure 1:
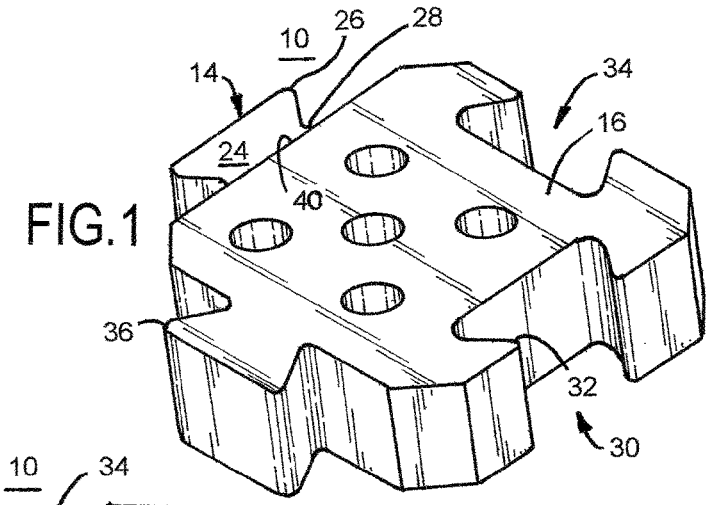
FIG. 1 is an isometric view of a sloped top revetment block having interlocking arms and sockets.
Figure 2:
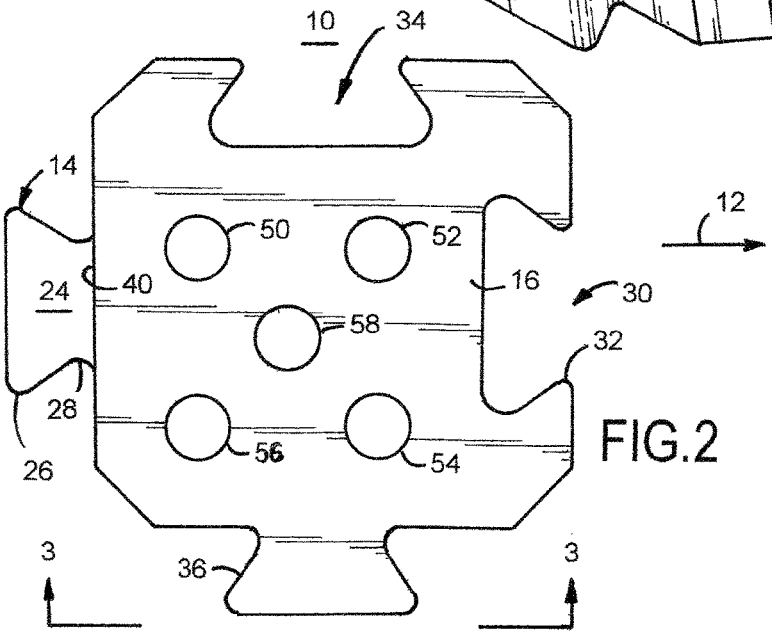
FIG. 2 is a top view of the sloped top interlocking block of FIG. 1.
Figure 3:
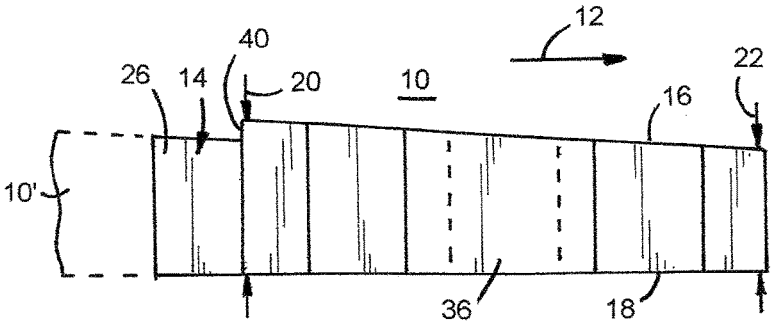
FIG. 3 is a side view of the sloped top interlocking block of FIG. 2.

With reference to FIGS. 1-3, there is illustrated a tapered top positive interlocking revetment block 10. The revetment block 10 is generally of the same construction as that described in U.S. Pat. No. 8,678,704, the disclosure of which is incorporated herein by reference in its entirety. The disadvantages of the prior art revetment blocks are described in detail in the '704 patent, as are the hydraulic advantages of the revetment blocks 10. When installed on the ground area to be protected from erosion, such as in a water channel, the tapered top revetment block 10 is oriented so that the water flows over the blocks in the direction opposite arrow 12. As will be described in more detail below, when installed on the land side of a levee, the revetment blocks 10 are installed so that the tapered tops of the blocks 10 slope downwardly in a downstream direction. In this orientation, the water surge in direction of arrow 12 encounters the frontal discontinuity or transition edge of each block 10 to thereby reduce the kinetic energy and slow down the water on the backside of the levee.

The arms and sockets of the block 10 allow a positive lateral interlock between each of the four neighbor blocks. With positive interlocking erosion control blocks, the advantage is that the hydraulic force of surging water cannot move the blocks laterally when they are interlocked together. The only way for a positive interlocking revetment block to be dislodged from the matrix is to be lifted vertically out of its interlocking engagement with the four neighbor blocks. The tapered top interlocking revetment blocks 10 can be installed on top of a woven or non-woven geotextile material covering the area to be protected from erosion.

In accordance with a feature of the tapered top interlocking revetment block 10, when the underlying ground becomes uneven or irregular, due to removal of soil, settling, or the like, the factor of safety of the mat is not compromised and thus the integrity thereof is maintained for longer periods of time and under more adverse conditions. The revetment block 10 includes a tapered or slanted top surface, a level bottom surface and interlocking arms and sockets. The revetment block 10 thus includes a thicker upstream portion and a thinner downstream portion. The revetment block 10 is installed with the thinner portion downstream (direction of arrow 12), and the thicker portion upstream. In accordance with the invention, the revetment block 10, and other similar blocks 10 forming the mat, include a downstream thinner portion and a thicker upstream portion. The tapered top revetment block 10 provides controlled hydraulic performance as the water flows over a levee, embankment, or similar barrier.

Each tapered top revetment block 10 includes an upstream arm 14 that fits into a socket 30 of the similarly-constructed upstream block. The block 10 is constructed with a downstream socket 30 into which the arm of a similarly-constructed downstream block fits. The positive interlocking arms and sockets will be described in more detail below. The revetment block 10 is constructed with other corresponding side arms and sockets that fit into the respective side sockets and arms of similarly-constructed neighbor blocks located on each side (not shown) of the revetment block 10. As can be appreciated, the water flowing downstream over the mat or blanket of tapered top revetment blocks 10 encounters an abrupt vertical transition edge of each of the blocks, thus creating turbulence and slowing down the velocity of the surge of water.

In the event that the underlying surface of the ground becomes irregular, the thinner downstream portion of the block raises to accommodate the ground irregularity. However, even when the thinner downstream portion of block 10 is lifted, there still exists a portion of an abrupt vertical transition edge which the flowing water encounters to reduce the velocity of the water. This is because the top of the downstream thinner portion may still not be above the thicker upstream portion of the neighbor downstream block 10. It can be seen that if the difference in the thickness between the thinner downstream portion and the thicker upstream portion is, for example 0.5 inch, then the ground irregularity can be up to 0.5 inch before the factor of safety of the block begins to be affected.

The tapered top revetment block 10 is constructed so that when the arms are interlocked within sockets of neighbor blocks, there is still sufficient articulation between blocks to accommodate ground contours normally encountered or expected. As can be further appreciated, the difference in thickness of each of the tapered top revetment blocks 10 can be determined or engineered as a function of the unevenness of the ground on which the blocks are to be installed. Thus, for each different installation, the blocks 10 can be engineered to guarantee a specified factor of safety as a function of the unevenness of the ground. In addition, for ground characteristics that change over time, the revetment blocks 10 can be initially constructed to provide a factor of safety based on the expected change over time. As noted above, a difference in the ground surface of about 0.5 inch is an industry standard by which factors of safety are determined.

In the event that the ground changes such that a bump is formed under the thicker upstream portion of the revetment block 10, then more of the vertical face of the block 10 will be exposed, thus facilitating the control of the water by slowing it down.

With reference again to FIGS. 1-3, there is illustrated the tapered top revetment block 10 that constitutes a majority of the blocks of a mat of blocks that lines the land side of a levee. The revetment block 10 can be constructed with concrete or other heavy material using block plant or wet cast techniques. The dimensions of the tapered top block 10 are not critical, but in the preferred embodiment the footprint is about 15 inches by 15 inches, with the arms extending beyond the body of the block and the sockets formed within the body of the block 10. The revetment block 10 has a tapered top surface 16 and a flat or level bottom surface 18. The thicker upstream end 20 of the block 10 is about 5.0 inches thick, and the thinner downstream end 22 is about 4.5 inches thick, as shown in FIG. 3. The angle of taper of the top surface 16 of the block 10 is about 1.9 degrees. When constructed of concrete, the overall weight of the tapered top base block 10 is between about 65-70 pounds.

The tapered top block 10 is constructed with an upstream arm 14 that includes a top surface 24 that is tapered with the same angle as the top surface 16 of the block 10. The upstream arm 14 includes an enlarged part 26 connected to the side edge of the block 10 by a narrowed portion 28. The downstream end 22 of the block 10 includes a socket 30 having a narrowed inlet 32 formed into the body of the block 10. A similar side socket 34 is formed in an adjacent side of the base block 10. A side arm 36 is formed in the block 10 opposite the side socket 34. Thus, there is a respective socket formed in the side of the block 10 opposite each arm. The upstream arm 14 of the revetment block 10 fits within a socket of a similarly-constructed upstream neighbor revetment block 10'. The downstream socket 30 receives therein an upstream arm of a similarly-constructed downstream neighbor revetment block. The side socket 34 of the block 10 receives therein a side arm of a similarly-constructed neighbor block. Lastly, the side arm 36 of the block 10 fits within a side socket of a similarly-constructed neighbor block. As can be appreciated, the tapered top revetment block 10, as well as the four similarly-constructed neighbor blocks, are installed by lowering the blocks down into the arms/sockets of the neighbor block(s). As such, the revetment blocks 10 of the mat cannot be removed by lateral movement, but only by lifting the blocks vertically out of positive interlocking engagement with the neighbor blocks.

As noted above, the top surface 16 of the block 10 is tapered downwardly from the upstream end 20 to the downstream end 22 thereof. The upstream end 20 of the tapered top surface 16 includes a discontinuity or transition edge 40 that rises abruptly about 0.5 inch to the beginning of the tapered top surface 16. The upstream arm 14 is also tapered downwardly toward the transition edge 40 with the same angle as the slope of the top surface 16. Moreover, the change in thickness in the upstream arm 14 is the same as that of the downstream socket 30 so that when the upstream arm 14 of the tapered top block 10 is engaged within the downstream socket of the neighbor block, a uniform tapered surface between the two engaged blocks is achieved. The degree of taper in the top surfaces of the blocks 10 can be different from that described above.

In the preferred embodiment, the tapered top block 10 is constructed by forming five holes therethrough from the top surface 16 to the bottom surface 18. The holes function to allow vegetation to grow therein and assist in anchoring the block 10 to the underlying ground of the land side of a levee. The specific spacing and hole size can also improve the hydraulic characteristics of the block 10. There are four holes 50, 52, 54 and 56 formed in the respective corners of a virtual square. A fifth hole 58 is formed in the middle of the virtual square. The diameter of each hole is about 2.0 inches, and the center of each of the four holes 50, 52, 54 and 56 is about 4.0 inches from the center of the central hole 58. The holes can be formed with different sizes and at different locations in the block according to the description of U.S. Pat. No. 8,123,435 entitled "Interlocking Revetment Block With Array of Vegetation Holes."

Figure 4:
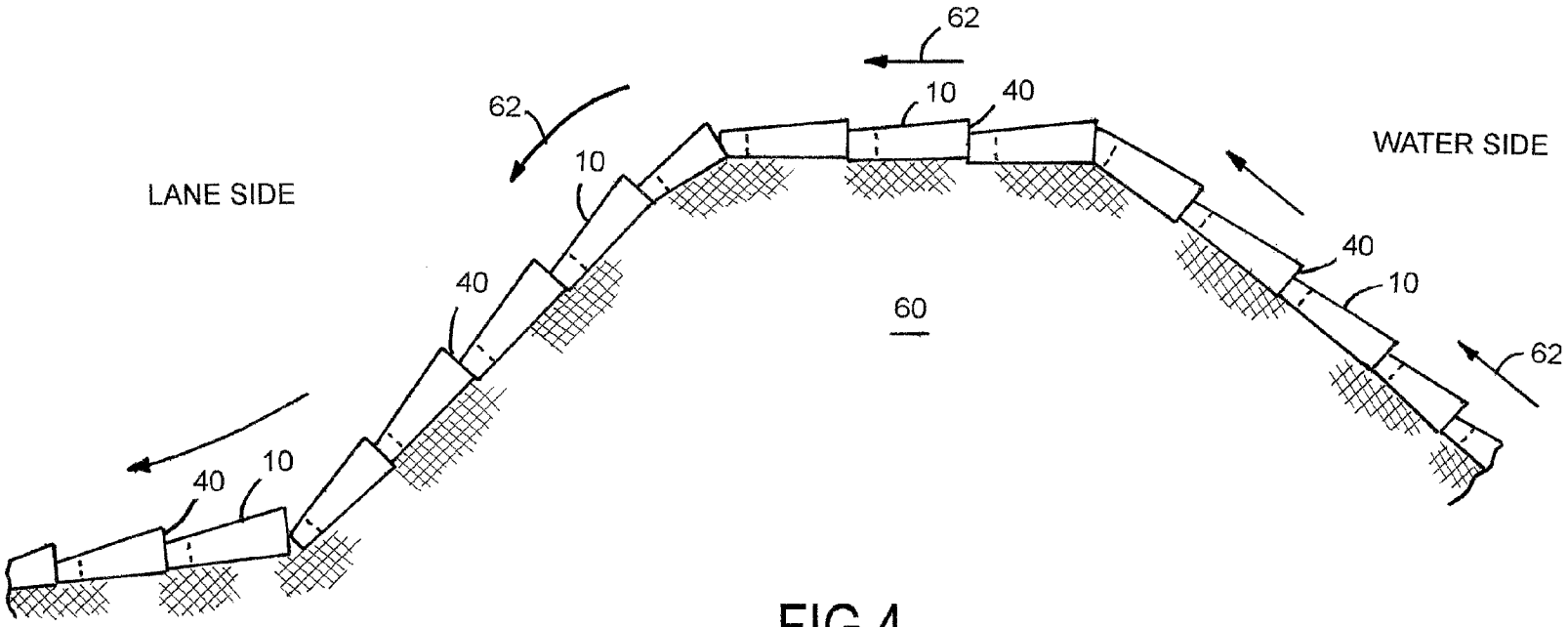
FIG. 4 is a side view of a mat of tapered top revetment blocks installed over a levee so that the kinetic energy of the water flowing thereover is reduced.

FIG. 4 illustrates a side view of a mat of tapered top revetment blocks 10 installed over levee 60. The levee 60 is of typical construction used to separate a river or body of water subject to flooding, from a ground area to be protected from flooding, such as a city. The New Orleans levees are examples of levee systems constructed by the U.S. Corps of Engineers to protect the city of New Orleans from flooding either by the Mississippi river or by the Gulf of Mexico during hurricanes. The levees 60 can be as high as fifty feet and forty feet thick at the base. On the water side of the levee 60, a surface lining is typically small rock or other material that prevents erosion as the river rises and runs downstream. The land side of the levee 60 typically relies on vegetation for the control of erosion, as there is no water flow on the land side except for normal rainfall, and during flooding and hurricanes.

According to an important feature of the invention, the tapered top revetment blocks 10 are installed on the water side of the levee 60, over the crest or top of the levee 60, and back down the land side of the levee 60. The tapered top revetment blocks 10 are installed in an orientation so that the abrupt transition edge 40 is exposed and faces the oncoming water flow. When each revetment block 10 is installed and interlocked in this manner, the abrupt transition edge 40 of each tapered top revetment block 10 presents an interruption to the laminar flow of water over the mat of revetment blocks 10. As the water flows over the tapered surface of each revetment block 10, it hits the abrupt transition edge 40 and thus turn upwardly into a turbulent flow, thus slowing the water velocity down. The upward turbulent flow of water at each abrupt transition edge 40 of the mat of blocks 10 creates turbulence in the other water flow in the vicinity to thus slow it down also. As such, the overall effect of the tapered top revetment blocks 10 installed in this orientation increases the roughness coefficient (Mannings N) and slows down the water flow and reduces the destructive effect of surges of water over the levee 60.

It has come to be appreciated that levees 60 are breached when wave surges 62 flow over the levee 60 at short intervals of time. When the surge 62 of water comes over the crest of the levee 60, it runs down the land side and otherwise picks up speed as it flows downhill. The surge 62 of water which already has significant velocity increases in velocity as it runs down the downhill side of the levee 60. The destructive force of the wave surge 62 is thus increased as it runs over the downhill side of the levee 60. When there is insufficient erosion protection of the levee 60 on the land side thereof, then the soil is carried away by the wave surge 62 and compromises the integrity of the levee 60. When a sufficient amount of the levee 60 has been eroded, then a portion of the levee 60 can collapse and allow the wave surges 62 to flow through the breach in the levee 60 and cause heavy flood damage to buildings on the land side of the levee 60.

It can be appreciated that by lining the land side of levees 60 with interlocking revetment blocks, the underlying soil is protected from erosion. The integrity of the levee 60 is thus maintained when surges 62 exceed the height of the levee 60. In addition, when tapered top revetment blocks 10 are utilized in lining the land side of a levee 60, the abrupt transition edge 40 of each block 10 has the effect of slowing down the velocity of the water surge 62 to thereby reduce its energy and the destructive force thereof. While not shown, the land side of the levee 60 can be lined with the tapered top revetment blocks 10 even where the ground levels out to the natural elevation. The tapered top revetment blocks 10 on the level area of the land side of the levee 60 function to continue reducing the velocity and energy of the wave surges 62.

With reference again to FIG. 4, the tapered top revetment blocks 10 on the water side of the levee 60 function to slow down the velocity of the wave surge 62 as it approaches the levee 60, and as it rises on the uphill side of the levee 60. The water flow of a wave surge is illustrated as arrows 62. Accordingly, wave surges 62 that would otherwise have the velocity to flow over the crest of the levee 60 can be reduced in velocity such that the surges 62 may never exceed the height of the levee 60. Thus, under certain circumstances, wave surges 62 which could otherwise cause destruction on the land side of the levee 60 will not have the velocity to cause such destruction. Moreover, even if the wave surges 62 have a height and energy sufficient to flow over the levee 60, the velocity and energy is nevertheless reduced by the tapered top revetment blocks 10 lining the water side of the levee 60. For the wave surges 62 that do flow over the levee 60, the tapered top revetment blocks 10 lining the land side of the levee 60 further reduce the velocity and energy so that such water flows with less destructive force.

It can be appreciated that a wave surge 62 can cause damage on the land side of the levee 60 by several means. One, the water 62 can flow on the land side of the levee 60 and flood buildings, vehicles, etc. In other words, the water can rise to a level on the land side of the levee 60 so that buildings, dwellings, vehicles, etc., are filled with water and corresponding damage is caused. Secondly, if the wave surges 62 have sufficient velocity and energy when flowing on the land side of the levee 60, the energy of the wave surges 62 may not only flood buildings and dwellings, but also destroy them by breaking walls so that the buildings are leveled and no longer exist. Indeed, high energy wave surges 62 can carry the resulting debris, vehicles, and other loose materials downstream to cause additional and collateral damage. When vehicles are carried downstream by a surge 62 of water, the vehicles can function as projectiles and ram buildings and bridges and cause additional damage. Thus, if only the tapered top revetment blocks 10 cause the wave surge 62 to slow down, the corresponding destruction of buildings and dwellings will be reduced, even if flooding still exists.

The wave action of the surging water 62 on the water side of a levee 60 is up and down the sloped side, until the wave has gained sufficient energy to flow over the top of the levee 60. This up and down wave action is illustrated as arrow 64 in FIG. 5 which shows the water flowing up the water side of the levee 60, and then back down as the wave surge recedes. This wave action is repeated many times until the wave either has enough energy to flow over the crest of the levee 60, or until the depth of the water carrying the wave is sufficiently high so that the surge of water flows over the crest of the levee 60. The flow of the surging water up and then down the water side of the levee 60 can also be slowed down by orienting the tapered top revetment blocks 10 so that the water flows into the abrupt transition edge 40 when flowing back down the levee 60. In other words, the tapered top revetment blocks 10 are oriented in one way on the land side of the levee 60, and then rotated 180 degrees and installed on the water side of the levee 60.

Figure 5:
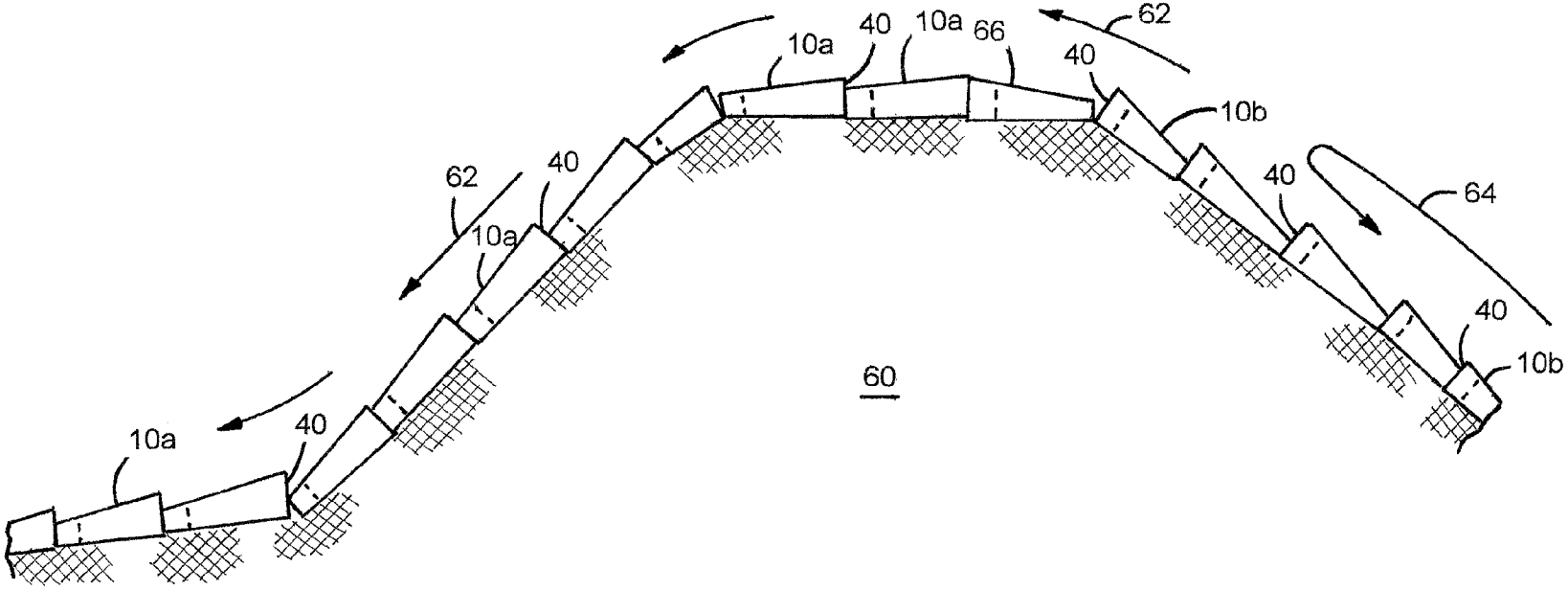
FIG. 5 is a side view of a mat of tapered top revetment blocks installed one way on the uphill or river side of the levee, and installed a different way on the land side of the levee.
Figure 6:
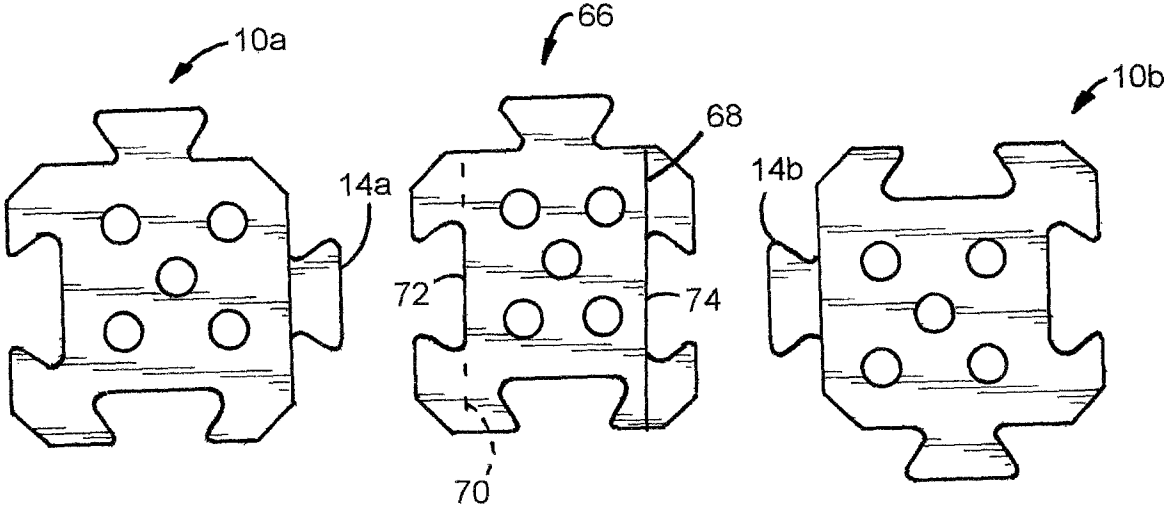
FIG. 6 is a top view of an interface revetment block that allows revetment blocks and rotated revetment blocks to be interlocked together.

When installing the tapered top revetment blocks 10 in the manner illustrated in FIG. 5, there is otherwise an arm/arm interface between blocks 10*a* and 10*b*, as illustrated in FIG. 6, on the crest of the levee 60. The tapered top revetment blocks 10*a* are installed on a portion of the crest of the levee 60, as well as on the land side slope of the levee 60. The tapered top revetment blocks 10*b* are rotated 180 degrees and installed on a portion of the crest of the levee 60, as well as on the sloped side of the water side of the levee 60. In this situation, a tapered top interface block 66 can be utilized to mate the interface row of revetment blocks 10*a* to the interface row of revetment blocks 10*b*. The tapered top interface block 66 includes a socket 72 for interlocking with the arm 14*a* of revetment block 10*a*, and an oppositely-located socket 74 for interlocking with the arm 14*b* of revetment block 10*b*. The interface block 66 is shown with an abrupt transition edge 68, which could be formed on the other side as abrupt transition edge 70 shown in broken line. Indeed, an abrupt transition edge could be formed on both upstream and downstream ends of the interface revetment block 66. In other words, the interface block 66 can be fabricated so that there is a first taper from the middle of the block and upwardly to the first transition edge 68, and a second taper from the middle of the block 66 to the left to the second transition edge 70.

Figure 7:
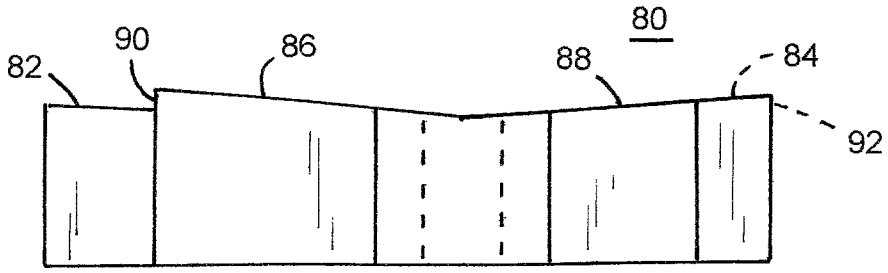
FIG. 7 is a side view of a revetment block having a double tapered top surface.

With reference back to FIG. 5, the tapered top revetment blocks 10*b* on the water side of the levee 60 are rotated 180 degrees to reduce the velocity of the water flowing back down the slope of the levee 60. Those skilled in the art may find it advantageous to construct a double slope block for use on the water side of the levee 60 so that the velocity and energy of the water is reduced once when flowing up the slope of the levee 60, and reduced again when the wave flows back down the water side of the levee 60. The double tapered top revetment block 80 of FIG. 7 illustrates such a revetment block.

The double taper top revetment block 80 is constructed with an arm 82 extending from a side of the body of the block 80 and a socket 84 formed in the opposite side of the revetment block 80. Otherwise, the arms and sockets of the block 80 are similar to that shown in FIG. 2. However, the revetment block 80 includes a first taper 86 that tapers upwardly from about the middle of the block 80 to the corresponding transition edge 90. A second taper 88 tapers upwardly from about the middle of the block 80 to the other transition edge 92. With two transition edges 90 and 92, the velocity and energy of the water flowing thereover is reduced when flowing either direction across the top of the block 80.

While the preferred and other embodiments of the invention have been disclosed with reference to specific revetment blocks, and associated methods of fabrication and installation thereof, it is to be understood that many changes in detail may be made as a matter of engineering choices without departing from the spirit and scope of the invention, as defined by the appended claims.

What is claimed is:

1. A method of controlling water flow over a levee having a water side and a land side, a top of the levee defining an upstream location and a lower elevation of the land side defining a downstream location, whereby water flows down the levee on the land side thereof from the upstream location to the downstream location, said method comprising:

lining the land side of the levee with a mat of revetment blocks, each said revetment block of said mat is identically constructed, and each said revetment block of said mat has an upstream frontal edge into which the water flowing down the levee on the land side abuts to thereby reduce the energy of the water, and each said revetment block of the mat has an upstream end thickness, as measured from a top surface of the revetment block to a bottom surface, that is thicker than a thickness of a downstream end of such revetment block, whereby each said revetment block of the mat has a tapered top surface which tapers downwardly with respect to a bottom surface thereof from an upstream end thereof to a downstream end;

situating the revetment blocks of said mat on the land side of the levee so that the respective upstream frontal edge of each said revetment block of said mat extends vertically above a downstream end of a respective similarly-constructed immediately adjacent upstream neighbor revetment block of the mat, thereby reducing the energy of the water flowing over the levee from the top of the levee to the lower elevation of the land side of the levee; and lining the water side of the levee with the revetment blocks that are rotated 180 degrees as compared to the revetment blocks lining the land side of the levee.

2. The method of claim 1, further including interlocking each said revetment block of the mat using positive interlocking arms and positive interlocking sockets, whereby interlocked neighbor revetment blocks cannot be laterally removed from each other.

3. The method of claim 1, further including using a revetment block having a tapered top surface that tapers downwardly from a transition edge of a body of said block toward an opposite end of said revetment block, and using an interlocking member of said revetment block that tapers downwardly toward said transition edge.

4. The method of claim 3, further including using an interlocking arm as said interlocking member.

5. The method of claim 1, wherein said mat defines a first mat of said revetment blocks, and further including lining a portion of a level elevation of a ground surface of the land side of the levee with a second mat of the revetment blocks so that after the water flows downhill on the land side of the levee the water flows over said second mat of said revetment blocks lining the level elevation to thereby continue reducing the velocity of the water flowing thereover.

6. The method of claim 1, further including lining a crest of the levee with the revetment blocks so that the energy of the water flowing over the crest is reduced.

7. The method of claim 1, further including using an interface block to provide an interface to the interlocking arms or sockets of the revetment blocks and the rotated revetment blocks.

8. The method of claim 7, further including installing the interface blocks on a crest of the levee.

9. The method of claim 1, further including lining the water side of the levee with revetment blocks that each include two sloped surfaces and two corresponding transition edges so that the energy of the water flowing uphill on the water side of the levee is slowed down and the water flowing back down the water side of the levee is again slowed down.

10. A method of controlling water flow over a levee having a crest located between a water side of the levee and a land side of the levee, comprising:

installing a first mat of revetment blocks on the land side of the levee from the crest of the levee to a downhill portion of the levee;

using said revetment blocks of the type where each said revetment block has interlocking male and female members for interlocking with similarly-constructed immediately adjacent revetment blocks, and engaging said male and female interlocking members to prevent lateral separation of neighbor revetment blocks, and using said revetment blocks where both the interlocking members extend from a bottom surface of each said revetment block to a tapered top surface thereof;

using said revetment blocks of the type having said tapered top surface tapering upwardly from a downstream end to an upstream end, said tapered top revetment blocks each having a thicker end with a given thickness as measured from a top surface of said revetment block to a bottom surface of said revetment block, and said tapered top revetment block having a thinner end opposite said thicker end, said thinner end having a thickness as measured from the top surface of said revetment block to the bottom surface thereof;

installing the tapered top revetment blocks so that the thicker end of each said revetment block is laid uphill on the downhill portion of the land side of the levee and the thinner end of each said revetment block is laid downhill on the downhill portion of the land side of the levee, so that a vertical transition edge is formed between neighbor revetment blocks;

using the transition edges of the revetment bocks to reduce the energy of the water flowing over the crest of the levee and down the land side thereof; and lining the water side of the levee with the revetment blocks that are rotated 180 degrees as compared to an orientation of the revetment blocks on the land side of the levee.

11. The method of claim 10, further including installing the blocks so that positive interlocking arms of each block of said revetment blocks interlock with positive interlocking sockets of respective neighbor blocks, said positive interlocking arms and sockets preventing lateral separation of the neighbor blocks.

12. The method of claim 10, further including using interface revetment blocks between a row of the revetment blocks and a row of the rotated revetment blocks, and constructing each said interface revetment block with a different number of arms than the revetment blocks lining the land side of the levee, each said revetment block and each said rotated revetment block and each said interface revetment block having at least one said arm.

13. A method of controlling water flow over a levee having a crest located between a water side and a land side, comprising:

using a first set and a second set of tapered top revetment blocks, each said first and second set of revetment blocks having respective top surfaces that are tapered with respect to respective bottom surfaces thereof, where the tapered top surface of each said revetment block of said first set and said second set terminate in an abrupt downward transition edge;

installing the first set of tapered top revetment blocks on the water side of the levee so that water returning downhill on the water side of the levee encounters the abrupt downward transition edges of said first set of tapered top revetment blocks and slows down the downhill flowing water; and installing the second set of tapered top revetment blocks on the land side of the levee so that water flowing over the crest and downhill on the land side of the levee encounters the abrupt downward transition edges of said second set of tapered top revetment blocks and slows down the water flowing downhill on the land side of the levee.

14. The method of claim 13, further including installing a row of interface blocks to interface the first set of tapered top revetment blocks on the water side of the levee to the second set of tapered top revetment blocks on the land side of the levee, and further including using interface blocks where each said interface block is constructed with a different number of arms as compared to the number of arms of each revetment block of the first set of tapered top revetment blocks, and each said interface block and each said revetment block of the first set of tapered revetment blocks having at least one said arm.

* * * * *